United States Patent [19]

Hueber et al.

[11] 4,063,850

[45] Dec. 20, 1977

[54] GAS TURBINE ENGINE HAVING A CERAMIC TURBINE WHEEL

[75] Inventors: Alfred Hueber, Munich; Klaus Hagemeister, Ebenhausen, both of Germany

[73] Assignee: Motoren- und Turbinen-Union Munchen GmbH, Munich, Germany

[21] Appl. No.: 744,219

[22] Filed: Nov. 22, 1976

[30] Foreign Application Priority Data

Dec. 3, 1975 Germany ..... 2554353

[51] Int. Cl.[2] ..... F04D 29/02; F01D 5/28

[52] U.S. Cl. ..... 415/214; 29/156.8 R; 60/200 A; 416/241 B; 415/107; 417/409

[58] Field of Search ..... 417/406, 407, 408, 409; 415/214, 107; 416/241, 244, 213; 308/238; 29/156.8 R; 60/39.75, 200 A; 256/332

[56] References Cited

U.S. PATENT DOCUMENTS

| | | | |
|---|---|---|---|
| 2,433,589 | 12/1947 | Adams | 415/212 |
| 2,864,552 | 12/1958 | Anderson | 417/407 |
| 3,459,133 | 8/1969 | Scheffler | 415/214 |
| 3,494,292 | 2/1970 | Walker et al. | 415/214 |
| 3,635,577 | 1/1972 | Dee | 415/214 |
| 3,905,723 | 9/1975 | Torti, Jr. | 415/214 |
| 3,943,703 | 3/1976 | Kronogard | 415/214 |
| 4,011,295 | 3/1977 | Tree et al. | 264/332 |
| 4,011,737 | 3/1977 | Krueger et al. | 416/241 B |

*Primary Examiner*—C. J. Husar
*Attorney, Agent, or Firm*—Alan H. Levine

[57] ABSTRACT

A gas turbine having a rotor including a ceramic turbine wheel and a rotor shaft formed in part of ceramic material, the wheel and ceramic shaft portion being formed as one piece. The ceramic shaft portion extends into a cooler zone of the engine where it is connected to a steel shaft portion. The ceramic shaft portion is supported by a radial bearing, preferably an air bearing. A ceramic disk projects radially from, and is formed as one piece with, the ceramic shaft portion, the disk cooperating with a thrust bearing, preferably an air bearing.

7 Claims, 1 Drawing Figure

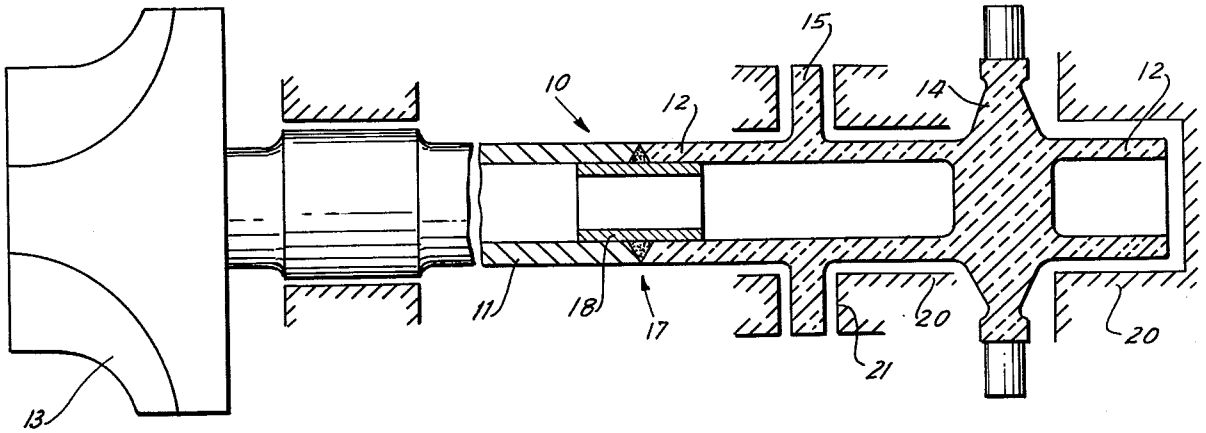
12
14
15
12
10
20
20
21
17
18
11
13

GAS TURBINE ENGINE HAVING A CERAMIC TURBINE WHEEL

This invention relates to a gas turbine engine having a rotor shaft carrying a ceramic turbine wheel.

Endeavoring to optimize the fuel consumption of gas turbines, developments in current technology have moved towards gas turbines of high cycle temperatures and maximally complete heat exchange exploiting the temperature gradient between the turbine exhaust gas and the compressor outlet air. This involves turbine inlet temperatures in excess of the present level, which runs at about 1300° K. To cope with such temperatures, resort is made to ceramic turbine wheels.

However, the use of a ceramic turbine wheel involves manufacturing problems. These mainly result from the great difference in the coefficients of thermal expansion of metal and ceramic, which difference prevents satisfactory connections between the turbine wheel and the shaft. An interlocking type of joint is all but impossible due to the poor machineability of the ceramic material. Interlocking joints would also be too unsafe due to the brittleness of the material, which might cause the turbine wheel to fracture where stress peaks are encountered.

A fusion type of joint will not provide reliable connections, because brazed joints, where at all possible between such materials, suffer when exposed to high temperatures. Mechanical connections are undesirable to the extent that the turbine wheel is generally weakened by provisions to receive fastening elements, as would be the case when holes are drilled in the wheel, especially as this might subject the rotating body to excessive stress peaks.

The intended high process temperatures also pose problems in terms of lubrication and cooling of the rotor bearings. Particularly, the lubrication requirement of the bearing at the turbine wheel can no longer be satisfied, the limited space around smalldiameter turbine wheels preventing adequate insulation and cooling.

In a broad aspect, the present invention provides a safe structural arrangement, and bearing provisions for the turbine rotor, to withstand the high gas temperatures prevailing in a gas turbine engine of the category described above.

It is a particular object of the present invention to provide an arrangement wherein the turbine wheel is an integral part of a ceramic shaft portion extending into a cooler zone of the engine.

In this arrangement, the point or points of connection are shifted. The rotor shaft extends from either side of the turbine wheel, to zones of lower temperature, where the two shaft portions can safely be joined together by conventional means while avoiding stress-inducing holes in the turbine wheel. This arrangement also eliminates the need for careful cooling of the shaft in the vicinity of the turbine wheel, as would be necessary for a continuous rotor shaft of steel.

The arrangement of the present invention not only eliminates the need for intensive cooling in the center of the turbine wheel but it also provides a further advantage in that it reduces the radial temperature gradient and thus the thermal stresses in the turbine wheel. Consequently, additional hot gases may deliberately be routed towards the center of the turbine wheel in order to reduce the temperature gradient resulting from the particular design and to relieve the thermal stresses in the transition from the wheel to the ceramic shaft.

The moderate thermal expansion of a ceramic material permits shaft bearings to be shifted to the ceramic shaft, where in accordance with this invention an air bearing is used to advantage. This practically eliminates the lubrication requirement.

In a further aspect of the present invention, the use of a thrust air bearing is facilitated by a ceramic radial projection with forms an integral part of the ceramic shaft. A ceramic shaft portion of this shape enables the use of a structurally combined axial-radial air bearing and substantially reduces the lubrication requirement commonly associated with an oil-lubricated bearing in the hot turbine zone.

The accompanying schematic drawing is an axial cross-sectional view and illustrates an embodiment of the apparatus assembled in accordance with the present invention.

A rotor shaft 10 comprises a steel shaft portion 11 and a ceramic shaft portion 12. Shaft portion 11 carries a compressor 13, and shaft portion 12 carries a turbine wheel 14. Turbine wheel 14 is made from a ceramic material and is formed integrally as one piece with shaft portion 12. Also formed as one piece with shaft portion 12 is a circular disk 15 projecting radially from the shaft portion. The place of connection of the metal portion to the ceramic portion of the shaft is located in a cooler zone 17 of the engine, at a distance from turbine wheel 14. The connection may be made by brazing, using suitable filler materials in circumferential face slots, or it may be any other suitable type of joint, such as an interlocking or fusing joint. If desired, a supporting tube 18 may be arranged within the hollow shaft portions bridging the seam between them.

Rotor shaft 10 is supported radially and axially at its turbine end. A radial air bearing 20 supports the right end of the rotor shaft, and a thrust air bearing 21 cooperates with the disk 15 to substantially prevent axial shifting of the rotor shaft 10. The air gaps of the air bearings have been greatly exaggerated for the sake of clarity. The air bearings 20 and 21 could be combined into a single unit, in which case the right end of shaft portion 12, shown within bearing 20, would be provided with projecting disk 15.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A gas turbine engine having a rotor including a rotor shaft and a turbine wheel, the turbine wheel being in a high temperature zone of the engine and the engine also having a cooler zone, the turbine wheel being made of a ceramic material, and the rotor shaft including a portion of ceramic material formed as one piece with the turbine wheel, said rotor shaft portion extending into the cooler zone of the engine.

2. A gas turbine as defined in claim 1 wherein the rotor shaft includes a steel portion coaxial with and connected to the ceramic shaft portion, the connection being in the cooler zone of the engine.

3. A gas turbine as defined in claim 1 wherein the ceramic portion of the rotor shaft projects from at least one side of the turbine wheel, and including a bearing supporting the rotor shaft, the ceramic shaft portion extending for a distance at least as long as the bearing.

4. A gas turbine as defined in claim 3 wherein the bearing is an air bearing.

5. A gas turbine as defined in claim 1 including a ceramic disk projecting radially from the ceramic shaft portion, the disk being formed as one piece with the ceramic shaft portion, and a thrust bearing cooperating with the disk to substantially prevent axial movement of the shaft.

6. A gas turbine as defined in claim 5 wherein the thrust bearing is an air bearing.

7. A gas turbine as defined in claim 6 including a radial air bearing supporting the ceramic shaft portion, the thrust and radial air bearings being combined as a single unit.

* * * * *